US010924845B2

(12) United States Patent
Peng et al.

(10) Patent No.: US 10,924,845 B2
(45) Date of Patent: Feb. 16, 2021

(54) MICROPHONE HAVING AN AIRTIGHT BACK CHAMBER

(71) Applicant: Taiwan Carol Electronics Co., Ltd., Taichung (TW)

(72) Inventors: Tzu-Huan Peng, Taichung (TW); Chung-Chi Lai, Taichung (TW); Chao-Chih Chang, Taichung (TW)

(73) Assignee: Taiwan Carol Electronics Co., Ltd, Taichung (TW)

( * ) Notice: Subject to any disclaimer, the term of this patent is extended or adjusted under 35 U.S.C. 154(b) by 0 days.

(21) Appl. No.: 16/825,993

(22) Filed: Mar. 20, 2020

(65) Prior Publication Data

US 2020/0366985 A1 Nov. 19, 2020

(30) Foreign Application Priority Data

May 14, 2019 (TW) ..... 108116573

(51) Int. Cl.
*H04R 1/28* (2006.01)
*H04R 1/04* (2006.01)
*H04R 1/08* (2006.01)

(52) U.S. Cl.
CPC ..... *H04R 1/2876* (2013.01); *H04R 1/04* (2013.01); *H04R 1/083* (2013.01)

(58) Field of Classification Search
CPC ... H04R 1/2869; H04R 1/2876; H04R 1/2892
See application file for complete search history.

(56) References Cited

U.S. PATENT DOCUMENTS 6,091,828 A * 7/2000 Akino ..... H04R 9/08 381/170
2009/0154753 A1* 6/2009 Akino ..... H04R 9/08 381/355
2017/0180849 A1* 6/2017 Akino ..... H04R 1/2853

FOREIGN PATENT DOCUMENTS

JP 2015015613 A * 1/2015

* cited by examiner

*Primary Examiner* — Mark Fischer
(74) *Attorney, Agent, or Firm* — Holland and Hart LLP

(57) ABSTRACT

A microphone includes an outer casing, a carrier disposed in the outer casing, and a sound receiving module connected to the carrier. The carrier has a through hole opposite to the sound receiving module. An airtight unit includes a shock absorber and an airtight member cooperating with the outer casing and the carrier to define an airtight back chamber configured to generate a pneumatic wave when a mechanical vibration wave is transmitted to the outer casing. A damping material closes the through hole and is configured to change the phase of the pneumatic wave when the latter passes therethrough such that the pneumatic wave and the mechanical vibration wave can offset each other when they are transmitted to the sound receiving module.

10 Claims, 7 Drawing Sheets

MICROPHONE HAVING AN AIRTIGHT BACK CHAMBER

CROSS-REFERENCE TO RELATED APPLICATION

This application claims priority to Taiwanese Patent Application No. 108116573, filed on May 14, 2019.

FIELD

The disclosure relates to a microphone, more particularly to a microphone having an airtight back chamber.

BACKGROUND

Referring to FIG. 1, a dynamic microphone 1, as disclosed in Taiwanese Patent Publication No. I304705B, includes an outer casing 11, a capsule 12 mounted inside the outer casing 11, and a first shock absorbing seat 13 and a second shock absorbing seat 14 mounted between the capsule 12 and the outer casing 11 and suspending the capsule 12 inside the outer casing 11. Through this, with the first and second shock absorbing seats 13, 14 absorbing the shocks, the capsule 12 is prevented from being interfered by noise, thereby achieving the purpose of reducing noise.

However, by virtue of its mechanical characteristic, the dynamic microphone 1 is very sensitive to low frequency vibration ranging from 50 to 300 Hz. Mechanical vibration generated by rubbing with the outer casing 11 when holding the dynamic microphone 1, or mechanical vibration generated by internal line impact caused by shaking, or mechanical vibration generated by the stage will still pass through the outer casing 11 and transmitted to the capsule 12 through the first and second shock absorbing seats 13, 14. Thus, there is still room for improvement of the aforesaid dynamic microphone 1.

SUMMARY

Therefore, an object of the present disclosure is to provide a microphone having an airtight back chamber that is capable of alleviating at least one of the drawbacks of the prior art.

According to this disclosure, a microphone includes an outer casing, a capsule unit, an airtight unit and a damping material. The outer casing includes an inner surface surrounding an axis and defining a chamber. The capsule unit includes a carrier disposed in the chamber, and a sound receiving module connected to the carrier for receiving sound. The carrier has a through hole opposite to the sound receiving module along the axis. The airtight unit includes a shock absorber connected to the inner surface of the outer casing and the carrier, and an airtight member spaced apart from the shock absorber and contacting the inner surface of the outer casing in an airtight manner. The airtight member, the shock absorber, the inner surface of the outer casing and the carrier cooperatively define an airtight back chamber. The airtight back chamber is configured to generate a pneumatic wave when a mechanical vibration wave is transmitted to the outer casing. The damping material closes the through hole in the carrier and is configured to change the phase of the pneumatic wave when the pneumatic wave passes therethrough such that the pneumatic wave and the mechanical vibration wave can offset each other when the pneumatic wave and the mechanical vibration wave are transmitted to the sound receiving module.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 2:
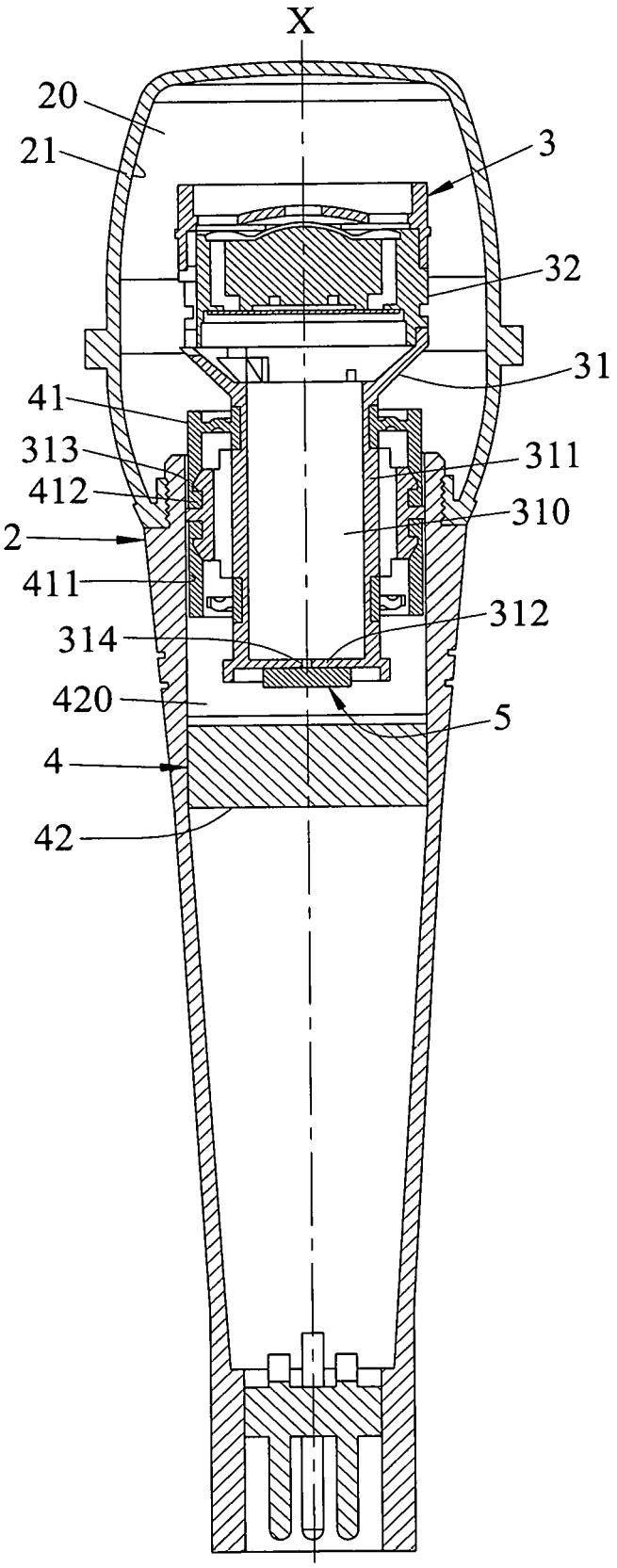
FIG. 2 is a sectional view of a microphone according to the embodiment of the present disclosure.
Figure 3:
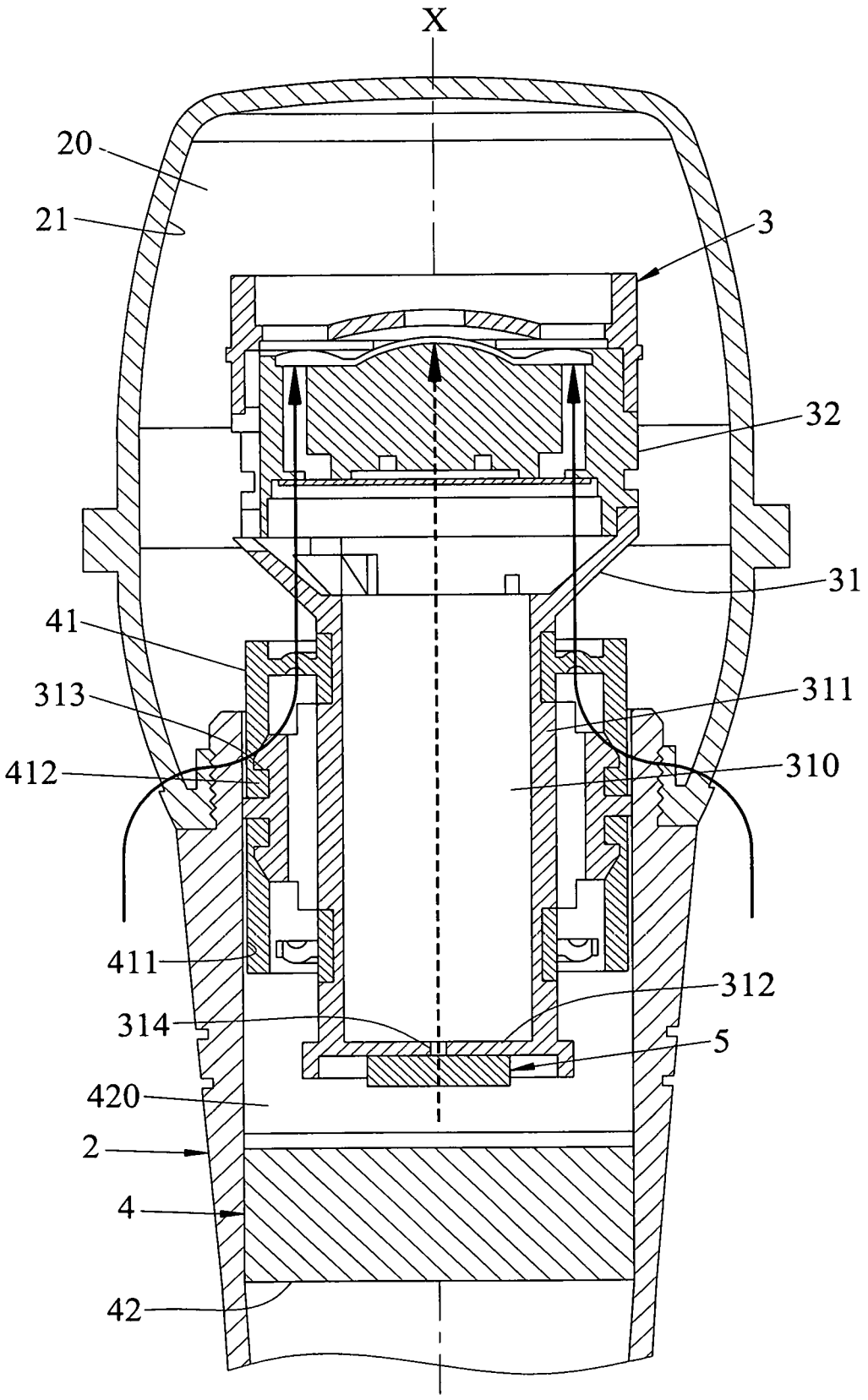
FIG. 3 is an enlarged fragmentary sectional view of the embodiment.

Referring to FIGS. 2 and 3, a microphone according to the embodiment of this disclosure includes an outer casing 2, a capsule unit 3, an airtight unit 4, and a damping material 5.

The outer casing 2 includes an inner surface 21 surrounding an axis (X) and defining a chamber 20.

The capsule unit 3 includes a carrier 31 disposed in the chamber 20, and a sound receiving module 32 connected to the carrier 31 for receiving sound.

The carrier 31 includes a surrounding wall 311 surrounding the axis (X) and defining a cavity 310, and a connecting wall 312 connected to one end of the surrounding wall 311 that is opposite to the sound receiving module 32. The surrounding wall 311 has two connecting portions 313 formed on an outer surface thereof. The connecting wall 312 has a through hole 314 extending therethrough along the axis (X) and communicating with the cavity 310. In this embodiment, each connecting portion 313 is a ring-shaped groove. The through hole 314 has a hole diameter ranging from 1 mm to 17 mm, and a hole area ranging from 0.79 $mm^2$ to 227 $mm^2$.

The airtight unit 4 includes a shock absorber 41 connected to the inner surface 21 of the outer casing 2 and the carrier 31, and an airtight member 12 spaced apart from the shock absorber 41 and contacting the inner surface 21 of the outer casing 2 in an airtight manner.

The shock absorber 41 has an outer peripheral surface 411 contacting the inner surface 21 of the outer casing 2 in an airtight manner, and two coupling portions 412 respectively coupled to the connecting portions 313. In this embodiment, each coupling portion 412 is a ring-shaped protrusion coupled to a respective one of the grooves or connecting portions 313.

It should be noted herein that each connecting portion 313 is not limited to a groove, and may be a protrusion, while each coupling portion 412 is not limited to a protrusion, and may be a groove for matching the protrusion. Moreover, the numbers of the connecting portions 313 and the coupling portions 412 are not limited to two, and may be one or more in other variations of this embodiment.

The airtight member 42, the shock absorber 41, the inner surface 21 of the outer casing 2 and the carrier 31 cooperatively define an airtight back chamber 420. The airtight back chamber 420 communicates with the through hole 314, and has a volume ranging from 5000 $mm^3$ to 36000 $mm^3$.

The damping material 5 is disposed on the connecting wall 312 of the carrier 31, and closes the through hole 314 in the carrier 31. In this embodiment, the damping material 5 may be a breathable paper, a breathable cloth, a felt, or a nylon cloth.

When mechanical vibration acts on the outer casing 2, apart from generating mechanical vibration waves, as shown by solid arrows in FIG. 3, that transmit from the outer casing 2 to the sound receiving module 32 through the shock absorber 41 and the carrier 31, the airtight back chamber 420 will also, by virtue of internal airflow vibration, generate a pneumatic wave, as shown by an arrow in dotted lines in FIG. 3. At this time, the pneumatic wave will transmit to the sound receiving module 32 through the damping material 5 and the cavity 310 of the carrier 31.

Since the vibration source of the pneumatic wave is also the mechanical vibration, its frequency will also range from 50 Hz to 300 Hz. When the pneumatic wave passes through the damping material 5, the phase and the amplitude of the pneumatic wave will change due to the sound resistance of the damping material 5. Through this, when the pneumatic wave and the mechanical vibration waves are transmitted to the sound receiving module 32, because their phases are different but their amplitudes are approximately the same, they can offset each other, so that the influence of the mechanical vibration to the sound receiving module 32 can be suppressed, thereby achieving the purpose of noise reduction.

Since the technical principle of the aforementioned shock absorbing is based on mutual offsetting between the airflow vibration and the mechanical vibration for achieving the effect of suppressing the vibration (theoretically called destructive interference), the parameters of the hole diameter and the hole area of the opening 313 or the parameter of the volume of the airtight back chamber 420 will all affect the amplitude and the phase of the pneumatic wave. When the foregoing parameters exceed the scope disclosed in this disclosure, the pneumatic wave and the mechanical vibration wave will not effectively offset each other, so that the effect of suppressing the vibration is lost. It is even possible to create phase overlap (constructive interference) so as to amplify the vibration.

Figure 1:
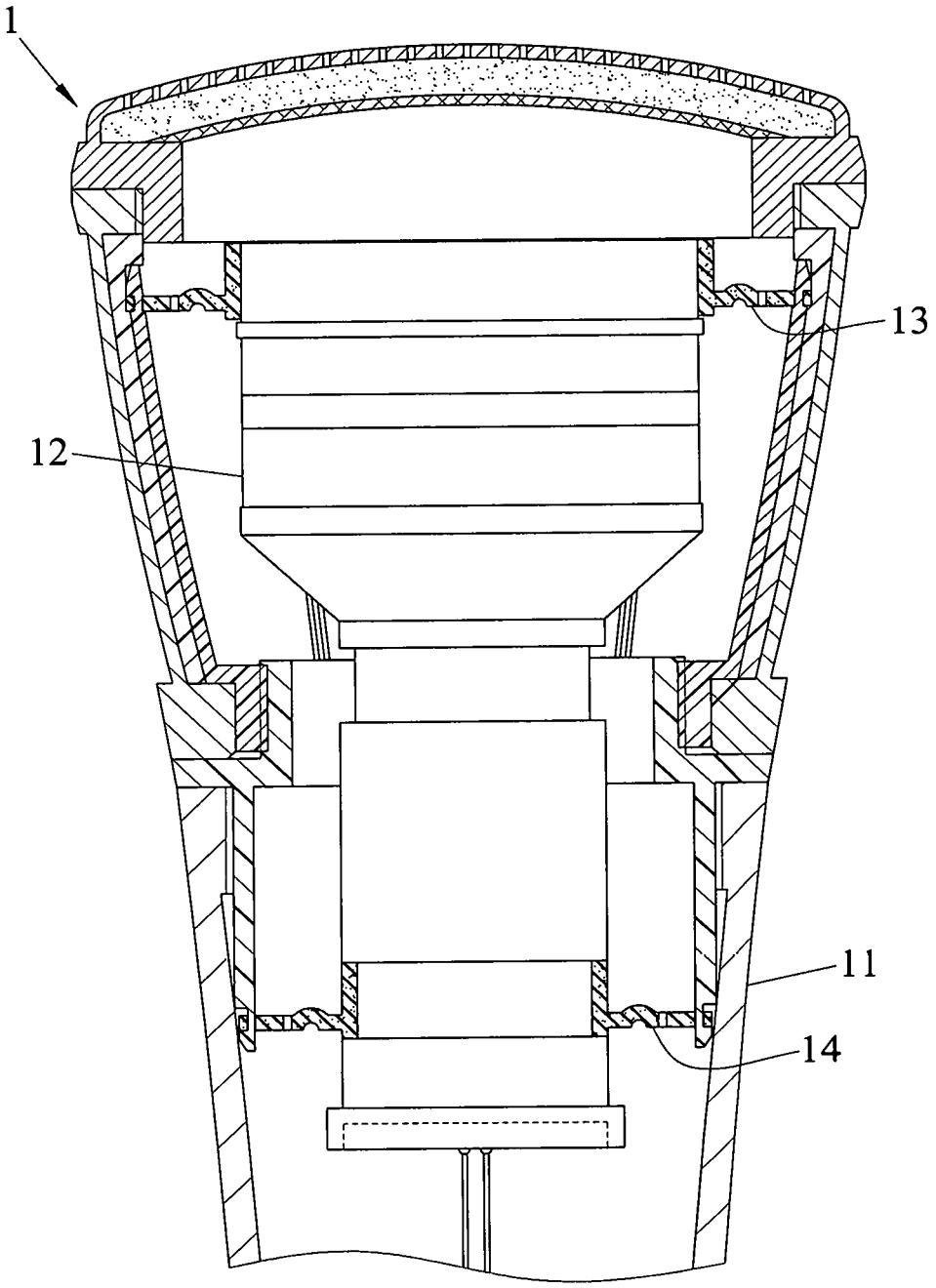
FIG.1 PRIOR ART
FIG. 1 is an enlarged fragmentary sectional view of a dynamic microphone disclosed in Taiwanese Patent Publication No. I304705B.
Figure 4:
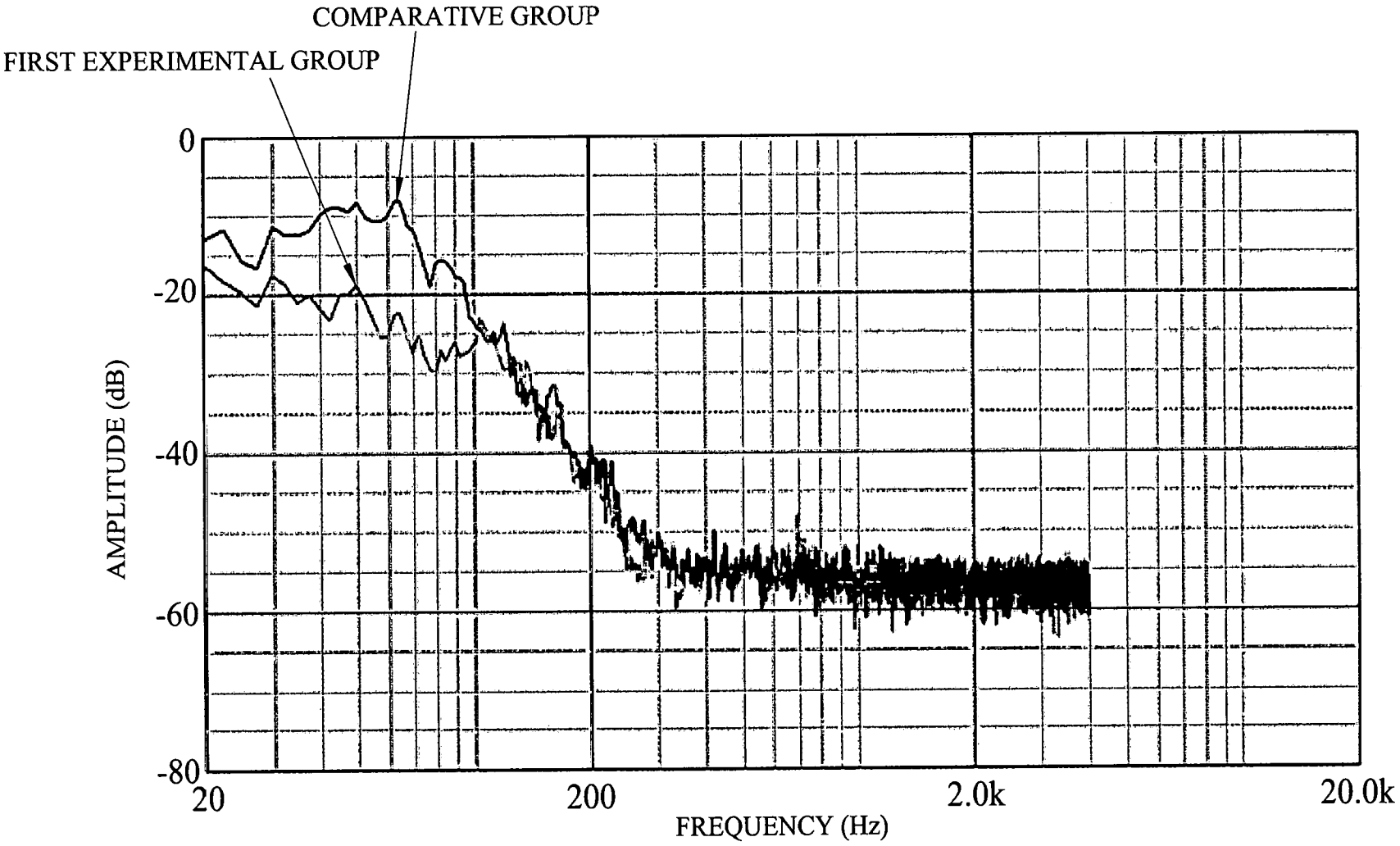
FIG. 4 is a test chart illustrating frequency response curves of First Experimental Group of the embodiment and a Comparative Group.

Referring to FIG. 4, in combination with FIG. 3, with the volume of the back chamber 420 being 11500 $mm^3$, the breathable paper as the damping material 5, and the hole diameter of the through hole 314 being 2.5 mm of the embodiment as the First Experimental group, and the dynamic microphone 1 shown in FIG. 1 as the Comparative Group, an amplitude (in decibel, dB) test is performed. It is clear from the test chart that, although the decibel value of the First Experimental group is higher than that of the Comparative Group in the frequency range of 100 to 200 Hz, the decibel value of the First Experimental group is far lower than that of the Comparative Group in the frequency range of less than 100 Hz.

Figure 5:
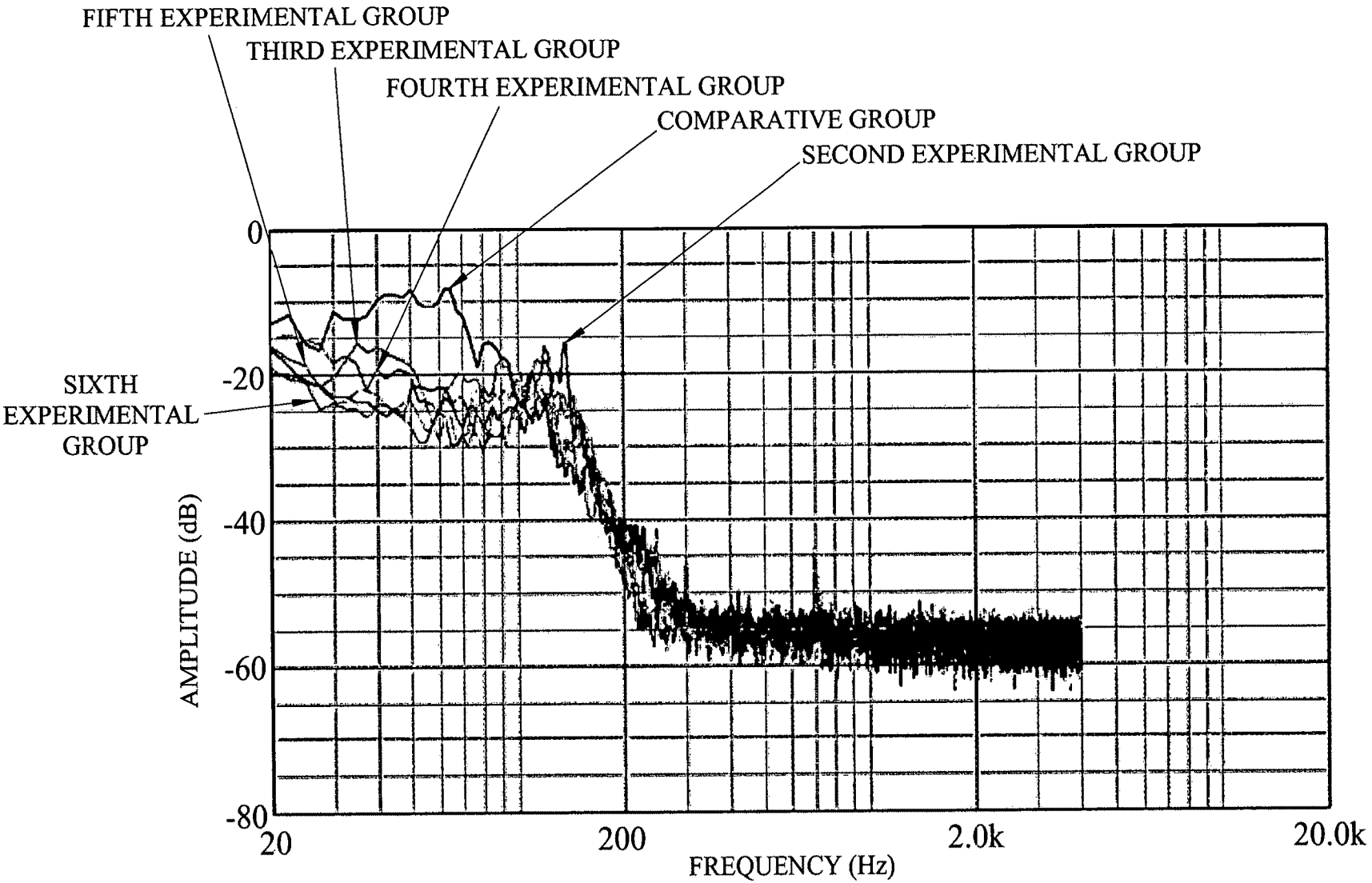
FIG. 5 is a test chart illustrating frequency response curves of Second to Sixth Experimental Groups of the embodiment and the Comparative Group.

Similarly, referring to FIG. 5, in combination with FIG. 3, with the volume of the back chamber 420 being 11500 $mm^3$, the breathable paper as the damping material 5, and the hole diameter of the through hole 314 being 2 mm of the embodiment as the Second Experimental group; with the volume of the back chamber 420 being 13300 $mm^3$, the breathable paper as the damping material 5, and the hole diameter of the through hole 314 being 2 mm of the embodiment as the Third Experimental group; with the volume of the back chamber 420 being 13300 $mm^3$, the breathable paper as the damping material 5, and the hole diameter of the through hole 314 being 2.5 mm of the embodiment as the Fourth Experimental group; with the volume of the back chamber 420 being 11500 $mm^3$, the breathable cloth as the damping material 5, and the hole diameter of the through hole 314 being 2.5 mm of the embodiment as the Fifth Experimental group; and with the volume of the back chamber 420 being 11500 $mm^3$, the breathable cloth as the damping material 5, and the hole (diameter of the through hole 314 being 2 mm of the embodiment as the Sixth Experimental group, it is found that the decibel values of the Second to Sixth Experimental Groups are far lower than the decibel value of the Comparative Group in the frequency range of less than 100 Hz.

Figure 6:
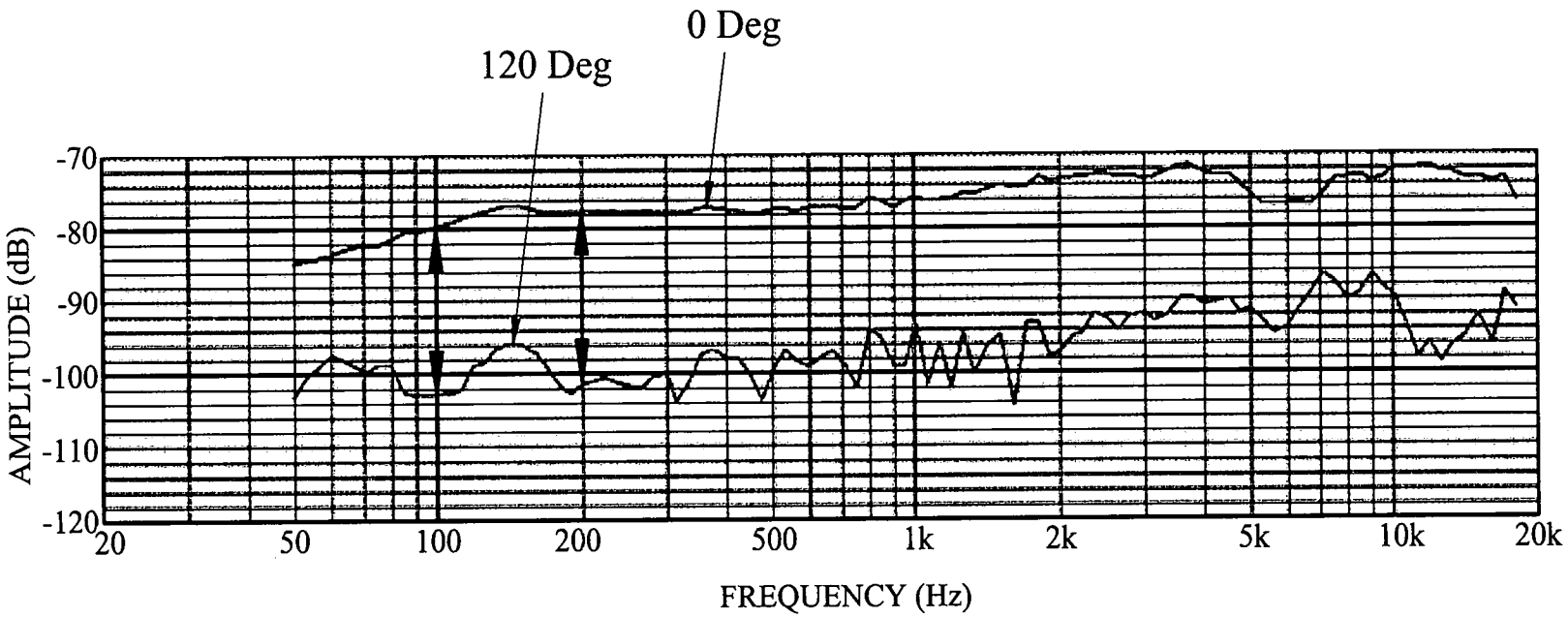
FIG. 6 is a test chart illustrating frequency response curves of the embodiment.
Figure 7:
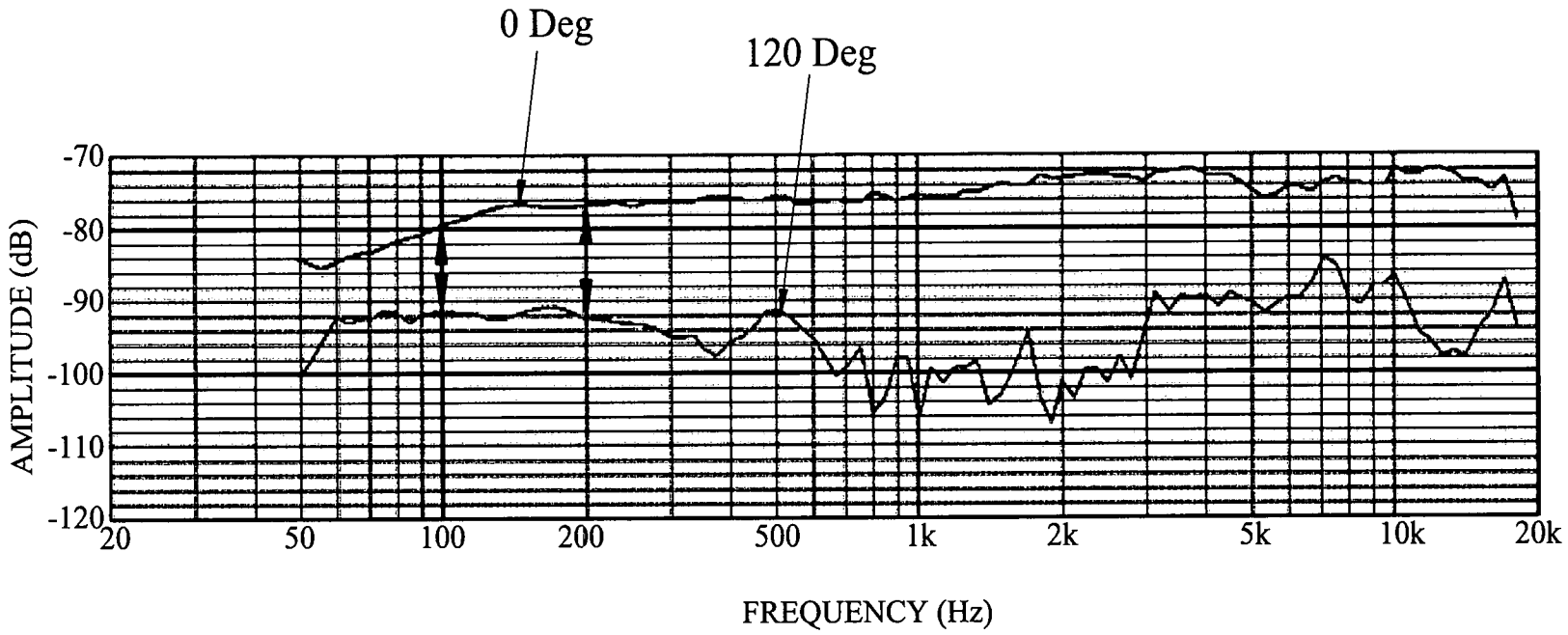
FIG. 7 is a test chart illustrating frequency response curves of the Comparative Group.

Referring to FIGS. 6 and 7, in combination with FIG. 3, further, from the frequency response curves of the First. Experimental Group (see FIG. 6) and the Comparative Group (see FIG. 7), it is evident that, in the frequency range of less than 200 Hz and in the sound reception angles of zero (0) degree and 120 degrees, the First Experimental Group is greater than the Comparative Group by 6 to 10 decibels (dB), so that the frequency response curve thereof in the low frequency has a stronger directivity.

From the forgoing, the advantages of the embodiment can be summarized as follows:

1) Through the disposition of the airtight back chamber 420 and the airtight member 42, this disclosure can generate a pneumatic wave that is opposite to the mechanical vibration phase, so that the mechanical vibration wave and the pneumatic wave can offset each other when they are transmitted to the sound receiving module 32, thereby effectively reducing noise.

2) This disclosure can increase acoustic compliance in acoustic properties, so that the frequency response curve thereof has a strong directivity at low frequency.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A microphone comprising:

an outer casing including an inner surface surrounding an axis and defining a chamber;

a capsule unit including a carrier disposed in said chamber, and a sound receiving module connected to said carrier for receiving sound, said carrier having a through hole opposite to said sound receiving module along the axis;

an airtight unit including a shock absorber connected to said inner surface of said outer casing and said carrier, and an airtight member spaced apart from said shock absorber and contacting said inner surface of said outer casing in an airtight manner, wherein said airtight member, said shock absorber, said inner surface of said outer casing and said carrier cooperatively define an airtight back chamber, said airtight back chamber being configured to generate a pneumatic wave when a mechanical vibration wave is transmitted to said outer casing; and a damping material closing said through hole in said carrier and configured to change the phase of said pneumatic wave when said pneumatic wave passes therethrough such that said pneumatic wave and the mechanical vibration wave can offset each other when said pneumatic wave and the mechanical vibration wave are transmitted to said sound receiving module.

2. The microphone as claimed in claim 1, wherein said airtight back chamber has a volume ranging from 5000 $mm^3$ to 36000 $mm^3$.

3. The microphone as claimed in claim 1, wherein said through hole has a hole diameter ranging from 1 mm to 17 mm.

4. The microphone as claimed in claim 1, wherein said through hole has a hole area ranging from 0.79 $mm^2$ to 227 $mm^2$.

5. The microphone as claimed in claim 1, wherein said pneumatic wave has a frequency ranging from 50 Hz to 300 Hz.

6. The microphone as claimed in claim 1, wherein said damping material is one of a breathable paper, a breathable cloth, a felt, and a nylon cloth.

7. The microphone as claimed in claim 1, wherein said carrier further has at least one connecting portion formed on an outer surface thereof, said shock absorber having an outer peripheral surface contacting said inner surface of said outer casing in an airtight manner, and at least one coupling portion coupled to said at least one connecting portion.

8. The microphone as claimed in claim 7, wherein one of said at least one connecting portion and said at least one coupling portion is a protrusion, and the other one of said at least one connecting portion and said at least one coupling portion is a groove.

9. The microphone as claimed in claim 1, wherein said carrier includes a surrounding wall surrounding the axis and defining a cavity, and a connecting wall connected to one end of said surrounding wall and having said through hole, said through hole communicating with said cavity and said airtight back chamber.

10. The microphone as claimed in claim 1, wherein said damping material is further configured to change the amplitude of said pneumatic wave that passes therethrough.

* * * * *